US010150127B2

(12) United States Patent
Tepas et al.

(10) Patent No.: US 10,150,127 B2
(45) Date of Patent: Dec. 11, 2018

(54) FOAM DISPENSING ASSEMBLY

(71) Applicant: TWIST BEAUTY PACKAGING AIRSPRAY N.V., RE Alkmaar (NL)

(72) Inventors: Marcus Cornelis Jacobus Tepas, Callantsoog (NL); Arjen Haisma, Amsterdam (NL); Peter Jozef Jan Albertz, Bloemendaal (NL)

(73) Assignee: Twist Beauty Packaging Airspray N.V., Alkmaar (NL)

( * ) Notice: Subject to any disclaimer, the term of this patent is extended or adjusted under 35 U.S.C. 154(b) by 407 days.

(21) Appl. No.: 14/411,178

(22) PCT Filed: Jun. 28, 2013

(86) PCT No.: PCT/NL2013/050471
§ 371 (c)(1),
(2) Date: Dec. 24, 2014

(87) PCT Pub. No.: WO2014/003568
PCT Pub. Date: Jan. 31, 2014

(65) Prior Publication Data

US 2015/0144661 A1 May 28, 2015

(30) Foreign Application Priority Data

Jun. 29, 2012 (NL) ..... 2009085

(51) Int. Cl.
*B05B 11/00* (2006.01)
*B05B 7/00* (2006.01)
*A47K 5/14* (2006.01)

(52) U.S. Cl.
CPC ..... *B05B 11/3087* (2013.01); *A47K 5/14* (2013.01); *B05B 7/0037* (2013.01);
(Continued)

(58) Field of Classification Search
CPC ..... B05B 11/3087; B05B 11/3001; B05B 11/0018; B05B 11/3052; B05B 7/0037; A47K 5/14
(Continued)

(56) References Cited

U.S. PATENT DOCUMENTS 6,398,079 B1 6/2002 Garcia et al.
7,147,133 B2 * 12/2006 Brouwer ..... B05B 7/0025 222/145.5
(Continued)

FOREIGN PATENT DOCUMENTS

CA 2505811 A1 10/2006
WO 2009130461 A1 10/2009

OTHER PUBLICATIONS

International Search Report dated Aug. 16, 2013 for PCT/NL2013/050471.

*Primary Examiner* — Patrick M Buechner
*Assistant Examiner* — Robert Nichols, II
(74) *Attorney, Agent, or Firm* — Banner & Witcoff, Ltd.

(57) ABSTRACT

The invention provides a dispensing assembly to dispense a foam, comprising: •—a double cylinder element (2) mounted or to be mounted in an opening of a container (100), comprising a liquid cylinder (3) and an air cylinder (4), wherein the liquid cylinder has a smaller diameter than the air cylinder, and wherein the liquid cylinder and the air cylinder are arranged substantially concentrically, and •—a piston assembly (10) comprising a liquid piston (11) and an air piston (12) for reciprocal movements in the liquid cylinder and air cylinder, respectively, and a common operating part for operating the liquid piston and air piston, • wherein a liquid pump chamber (14) is at least delimited by the liquid cylinder and the liquid piston, said liquid pump chamber having a liquid inlet (15) and a liquid outlet (16), • wherein an air pump chamber (25) is at least delimited by the air cylinder, the air piston and the liquid piston, said air pump chamber having an air inlet (26) and an air outlet (27), • wherein the piston assembly (10) further comprises a
(Continued)

dispensing channel (28) in fluid communication with the liquid outlet and the air outlet, wherein the dispensing channel ends in a dispensing opening (29), • characterized in that the air outlet (27) is provided in the liquid piston in a region of the air pump chamber opposite to the air piston (12).

18 Claims, 6 Drawing Sheets

(52) U.S. Cl.
CPC ..... *B05B 11/3001* (2013.01); *B05B 11/00442* (2018.08); *B05B 11/3052* (2013.01)

(58) Field of Classification Search
USPC ..... 222/190, 321.7, 383.1, 145.1, 189.11
See application file for complete search history.

(56) References Cited

U.S. PATENT DOCUMENTS 7,246,723 B2 * 7/2007 Santagiuliana ..... B05B 11/3008 222/190
7,337,930 B2 * 3/2008 Ophardt ..... B05B 11/3087 222/190
8,561,849 B1 * 10/2013 Wang ..... B05B 7/0037 222/145.5
9,004,319 B2 * 4/2015 Kim ..... B05B 7/0037 222/190

* cited by examiner

FOAM DISPENSING ASSEMBLY

CROSS-REFERENCE TO RELATED APPLICATIONS

The present application is a U.S. National Phase filing of International Application No. PCT/NL2013/050471, filed on Jun. 28, 2013, designating the United States of America and claiming priority to Netherlands Patent Application No. 2009085, filed Jun. 29, 2012, and this application claims priority to and the benefit of the above-identified applications, which are both incorporated by reference herein in their entireties.

The present invention relates to a foam dispensing assembly and a foam dispensing device comprising a foam dispensing assembly.

U.S. Pat. No. 5,443,569 discloses a foam dispensing device comprising a foam dispensing assembly. The foam dispensing assembly is configured to dispense a foam and comprises a double cylinder element mounted in an opening of a container. The double cylinder element has a liquid cylinder and an air cylinder, wherein the liquid cylinder has a smaller diameter than the air cylinder. The liquid cylinder and the air cylinder are arranged substantially concentrically. The foam dispensing assembly further comprises a piston assembly comprising a liquid piston and an air piston for reciprocal movements in the liquid cylinder and air cylinder, respectively, and a common operating part for operating the liquid piston and air piston. A liquid pump chamber is at least partially defined by the liquid cylinder and the liquid piston, wherein the liquid pump chamber has a liquid inlet and a liquid outlet. An air pump chamber having an air inlet and an air outlet is at least partially defined by the air cylinder and the air piston. The piston assembly further comprises a dispensing channel in fluid communication with the liquid outlet and the air outlet, the dispensing channel ending in a dispensing opening.

A drawback of the known foam-forming assembly is that ingress of liquid into the air pump chamber may lead to accumulation of liquid in the air pump. This is undesirable as the presence of liquid, for instance soap, in the air pump chamber may hamper the functioning of the air piston pump. Therefore, conventional foam-forming assemblies having an air piston pump are designed to avoid or at least to decrease the ingress of liquid or foam into the air pump chamber. Generally, the liquid may enter the air pump chamber via the air inlet or air outlet.

Different solutions have been proposed to decrease the risk of ingress of liquid into the air pump chamber. For example, U.S. Pat. No. 6,536,629 and US patent application US 2007/0215642 A1 disclose foam dispensing assemblies comprising additional features to avoid ingress of liquid into the dispensing assembly.

The aim of the invention is to provide a foam dispensing assembly which does not have the above-mentioned drawback or at least to provide an alternative dispensing assembly for a foam dispensing device.

The invention provides a foam dispensing assembly comprising:

a double cylinder element mounted or to be mounted in or on an opening of a container, comprising a liquid cylinder and an air cylinder, wherein the liquid cylinder has a smaller diameter than the air cylinder, and wherein the liquid cylinder and the air cylinder are arranged substantially concentrically, and a piston assembly comprising a liquid piston and an air piston for reciprocal movements in the liquid cylinder and air cylinder, respectively, and a common operating part for operating the liquid piston and air piston, wherein a liquid pump chamber is at least delimited by the liquid cylinder and the liquid piston, said liquid pump chamber having a liquid inlet and a liquid outlet, wherein an air pump chamber is at least delimited by the air cylinder, the air piston and the liquid piston, said air pump chamber having an air inlet and an air outlet, wherein the piston assembly further comprises a dispensing channel in fluid communication with the liquid outlet and the air outlet, wherein the dispensing channel ends in a dispensing opening, characterized in that the air outlet is at least partly provided in the liquid piston in a region of the air pump chamber opposite to the air piston.

With this arrangement liquid present in the air pump chamber, can be pumped out of the air pump chamber by actuation of the air pump. Since a substantial part of the liquid present in the air pump chamber will be pumped out of the air pump chamber during a dispensing stroke of the piston assembly, there will be less accumulation of liquid in the air pump chamber. As a result, the risk of malfunctioning of the air piston pump due to liquid present in the air pump chamber is substantially reduced.

The air outlet is preferably completely formed in the liquid piston.

The foam-forming assembly is configured to be used in an upright position. This means that the foam-forming assembly is intended to be held in such orientation during actuation of the liquid pump and air pump, that the piston assembly will be moved downwardly during the actuation stroke, i.e. in the stroke where the common operating part is depressed.

As a result of this upright position, any liquid present in the air pump chamber will flow due to gravity to a region opposite the air piston, i.e. close to the location where the air outlet of the air pump chamber is arranged. By actuation of the air pump the liquid may be pumped out of the air pump chamber.

It is remarked that in the upright position, the foam dispensing assembly may also be tilted with respect to the vertical axis, as long as the air piston will move downwards during the actuation stroke, i.e. the movement has a downwards vector component during actuation of the foam-forming assembly. During dispensing, the foam dispensing assembly and the associated direction of movement of the piston assembly may be tilted with a maximum angle of 70 degrees from the vertical axis, preferably with a maximum angle of 45 degrees from the vertical axis.

The double cylinder element is an element both comprising the liquid cylinder and the air cylinder. Preferably, the double cylinder element is an integral element, i.e. molded as a single piece. The double cylinder element is mounted or to be mounted in or on an opening of a container.

Usually, the foam dispensing assembly comprises a collar element configured to mount the double cylinder element in or on an opening of a container, for instance by a screw thread, snap or bayonet connection between the collar and the container. The collar element may further be designed to limit at least one end of a stroke of the piston assembly with respect to the double cylinder element, in particular to limit a return stroke of the piston assembly with respect to the double cylinder element in which the internal volumes of air pump chamber and liquid pump chamber increase to suck in air and liquid, respectively. The collar element may be integrally formed with the double cylinder element.

The piston assembly comprises a dispensing channel in direct fluid communication with the liquid outlet and the air outlet. The liquid outlet directly connects the liquid pump chamber with the dispensing channel and the air outlet directly connects the air pump chamber with the dispensing channel, i.e. the liquid does not flow via the air pump chamber and the air does not flow via the liquid pump chamber. The air outlet and the liquid outlet may be formed by completely separate channels from the air pump chamber and the liquid pump chamber to the dispensing channel, but in other embodiments the air outlet and liquid outlet may be partly formed by the same channel.

A first part of the dispensing channel, where liquid outlet and air outlet end in the dispensing channel forms a mixing space for mixing liquid entering the dispensing channel from the liquid outlet with air entering the dispensing channel from the air outlet. As both the liquid outlet and the air outlet are directly connected to the dispensing channel, the liquid and air commingle in the dispensing passage to form a foam. During actuation there is no or little formation of a mixture of air and liquid in the air pump chamber or liquid pump chamber.

In an embodiment, the air pump chamber is arranged completely above the liquid pump chamber. By arranging the air pump chamber completely above the liquid pump chamber, liquid present in the air pump chamber may be collected in the liquid cylinder, at the outer surface of the liquid piston.

In an embodiment, the air outlet is arranged at or near the bottom of the air pump chamber. By arranging the air outlet at or near the bottom of the air pump chamber in a foam forming assembly that is intended to be used in an upright position, any liquid present in the air pump chamber will flow towards the bottom of the air pump chamber resulting in that the liquid will be pumped out of the air pump chamber through the air outlet upon actuation of the air pump.

In an embodiment, the liquid piston comprises an internal channel, wherein said internal channel is part of the dispensing channel and wherein the air outlet and liquid outlet are in fluid communication with the internal channel. The internal channel may function as a mixing space where liquid from the liquid outlet and air from the air outlet are mixed to form a mixture of gas and liquid. The mixture is pumped through the internal channel to the dispensing opening where it may be dispensed as a foam. In the dispensing channel one or more foam-forming means such as sieves or meshes may be provided through which the mixture of liquid and air may be forced to promote the formation of a relatively fine and homogenous foam. Also accelerator holes or other foam improving features may be provided in the dispensing channel.

In an embodiment, the air outlet and liquid outlet are connected to the internal channel at or close to one end of the internal channel, wherein the internal channel extends over the complete length of the liquid piston. In such embodiment the complete internal channel forms a first part of the dispensing channel. A second part of the dispensing channel is preferably formed by the common operating part.

In an embodiment, the liquid piston comprises a valve element forming a valve in the liquid outlet. To improve the pump action of the liquid pump a valve element may be provided in the liquid outlet. Also, in the air outlet a valve element may be provided. In an alternative embodiment, the air outlet may also be an open channel from the air pump chamber to the dispensing channel. Preferably, the open channel may have over at least a part of its length a relatively small cross area forming a restriction in the air outlet.

In an embodiment, the liquid piston comprises:

a liquid piston seal element forming a seal between the liquid cylinder and the liquid piston, and an elongate hollow rod element, wherein one end of the rod element is connected to the liquid piston seal element and the other end of the rod element is connected to the common operating part. Such embodiment of the liquid piston provides a simple and reliable construction. The air outlet may for example be formed by a space between the liquid piston seal element and the rod element or by one or more openings provided in the piston seal element or the rod element. The hollow space in the rod element may form an internal channel which is part of the dispensing channel.

In an embodiment, the liquid piston seal element comprises an opening forming the liquid outlet, wherein the liquid piston element comprises a valve element, wherein the valve element and the liquid piston seal element are movable with respect to each other between a closed position in which the opening is substantially closed by the valve element, and an open position in which the opening is at least partially open.

In an embodiment, the valve element comprises an annular sealing surface to cooperate with an annular sealing surface on the liquid piston seal element.

In an embodiment, the internal channel in the rod element comprises a constriction, wherein the valve element comprises a disc shaped part having a sealing surface to form in the closed position a substantially sealing engagement with the piston seal element, and an elongate extension part extending into the hollow rod element, wherein a free end of the extension part comprises a bulge with a diameter larger than the diameter of the constriction in the internal channel.

In an embodiment, the liquid cylinder is not enclosed by the air cylinder, wherein the double cylinder element comprises a connecting wall connecting a bottom end of the air cylinder with a top end of the liquid cylinder, and wherein the connecting wall is designed such that, in the upright position of the dispensing assembly liquid in the air pump chamber will run towards the liquid cylinder, in particular towards the air outlet provided in the liquid piston. Preferably, the connecting wall is conically or frusto-conically shaped.

In an embodiment, a spring support element is arranged in the double cylinder element, wherein a spring is arranged between the spring support element and the piston assembly to bias the piston assembly in an upper position of an actuation stroke, and wherein the spring support element comprises a stop which holds the piston seal element and the valve element in the closed position with respect to each other.

In an embodiment, the liquid piston comprises a cylindrical piston rod and the foam pump assembly comprises a cylindrical spring element, in particular a helical spring element, arranged to bias the piston assembly to a start position of an actuation stroke, wherein the cylindrical spring element is arranged around the cylindrical piston rod, and wherein an inner diameter of the cylindrical spring element is slightly larger than an outer diameter of the piston rod, such that the cylindrical piston rod guides the piston rod during compression of the cylindrical spring element in an actuation stroke of the piston assembly.

In an embodiment, the dispensing channel comprises a one way valve which only allows a flow towards the dispensing opening. By providing a one-way valve in the dispensing channel, it is avoided or at least substantially reduced that during a return stroke of the piston assembly foam, liquid and/or air is drawn from the dispensing channel into the air pump chamber, in particular when no return valve is present in the air outlet.

In an embodiment, the piston assembly is configured such that upon actuation of the piston assembly, pumping of air out through the air outlet starts before pumping of liquid through the liquid outlet. By starting the pumping of air before the pumping of liquid it is avoided that liquid will enter the air pump chamber through the air outlet. This may for example be created by a lost motion liquid piston and an air piston fixed to the common operating part, or by a lost motion liquid piston and a lost motion air piston, wherein the lost motion displacement of the liquid piston pump, i.e. the part of the pump stroke where no liquid is pumped, is larger than the lost motion displacement of the air piston pump.

The invention further relates to a foam dispensing device comprising:

a container containing a foamable liquid and having an opening, and the dispensing assembly of any of the preceding claims mounted on or in the opening of the container.

In an embodiment, the double cylinder element comprises an aeration opening providing a fluid communication between an interior of the container and the environment, and wherein the air piston in an upper position is in sealing engagement with a sealing element, in which the sealing element and the air piston cover the aeration opening so that the fluid communication between the interior of the container and the environment is closed, and wherein when the air piston is moved downwards from the upper position there is a spaced relationship between the air piston and the sealing element so that air can flow from the environment to the interior of the container.

This sealing engagement between the air piston and the sealing element, for instance an annular ring, provides an efficient and effective sealing of an aeration opening in the double cylinder element in a rest or transport position of the piston assembly.

Embodiments of a foam dispensing assembly and foam dispensing device according to the invention will now be described in further detail, by way of example only, with reference to the accompanying drawings, in which.

Figure 1:
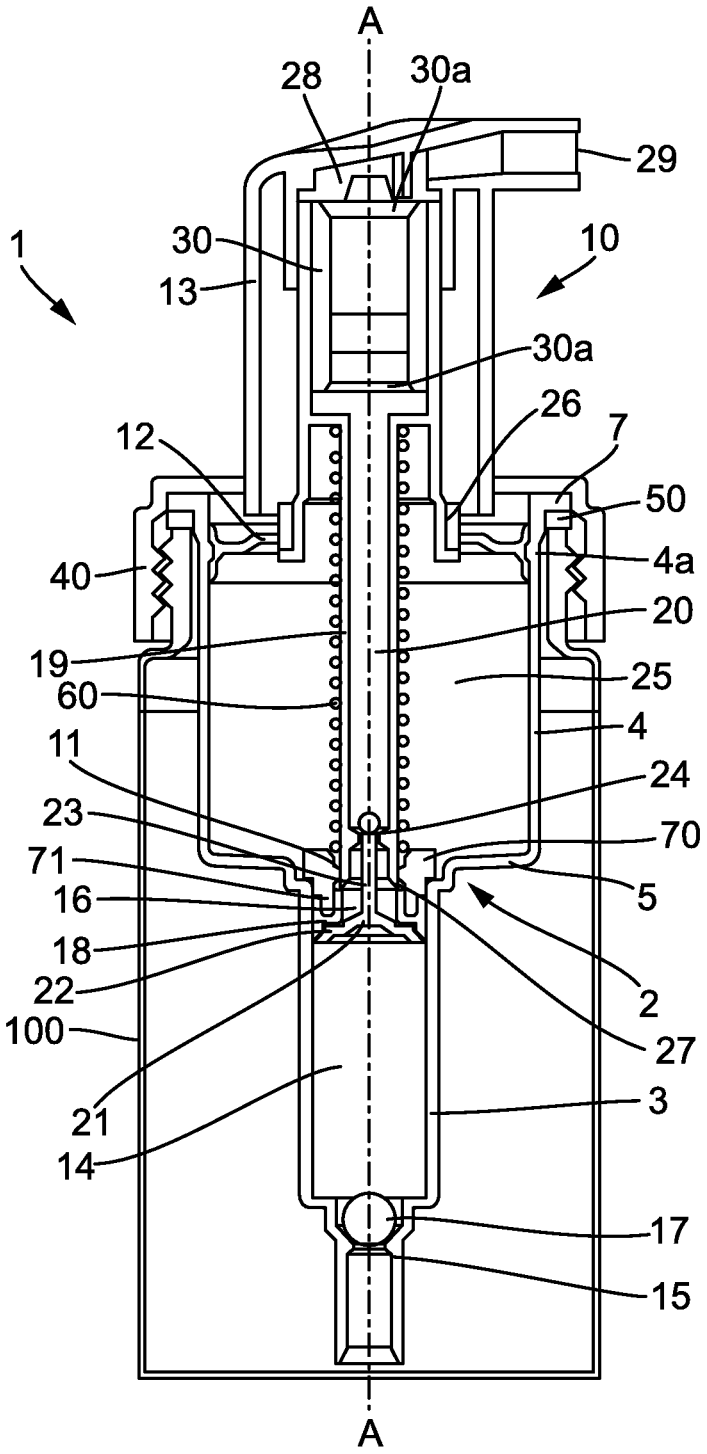
FIG. 1 depicts a first embodiment of a foam dispensing device according to the invention.

FIG. 1 shows a first embodiment of a foam dispensing assembly according to the invention, generally indicated by reference numeral 1. The foam dispensing assembly comprises a double cylinder element 2, having a liquid cylinder 3 and an air cylinder 4. A top end of the liquid cylinder 3 is connected to a bottom end of the air cylinder 4 by a connecting wall 5. The diameter of the air cylinder 4 is substantially larger than the diameter of the liquid cylinder 3.

The liquid cylinder 3 and the air cylinder 4 are arranged substantially concentrically with respect to each other and about a longitudinal axis A-A of the dispensing assembly 1. The liquid cylinder 3 is completely arranged below the liquid cylinder 4.

The air cylinder 4 comprises an opening 4*a* through which air may be introduced into the container 100 to replace liquid pumped out of the container 100.

The double cylinder element 2 is arranged in an opening of a container 100. The double cylinder element 2 comprises at the top end of the air cylinder a flange 7 with which the double cylinder element 2 is mounted with a securing collar 40 on a screw thread arranged on the container 100. A sealing ring 50 is arranged between the flange 7 and the securing collar 40 to provide sealing of the interior of the container 100.

The dispensing assembly 1 may also be mounted in any other suitable way on the container 1, for example a click-fit or bayonet connection.

The dispensing assembly 1 further comprises a piston assembly 10 comprising a liquid piston 11 and an air piston 12 for reciprocal movements in the liquid cylinder 3 and the air cylinder 4, respectively, and a common operating part 13 for operating the liquid piston 11 and the air piston 12.

A liquid pump chamber 14 is formed by the space delimited by the liquid piston 11 and the liquid cylinder 3. The liquid pump chamber 14 comprises a liquid inlet 15 and a liquid outlet 16. A ball valve 17 is arranged in the liquid inlet 15 as a one-way valve to avoid that liquid is pumped back into the container 100.

Figure 2:
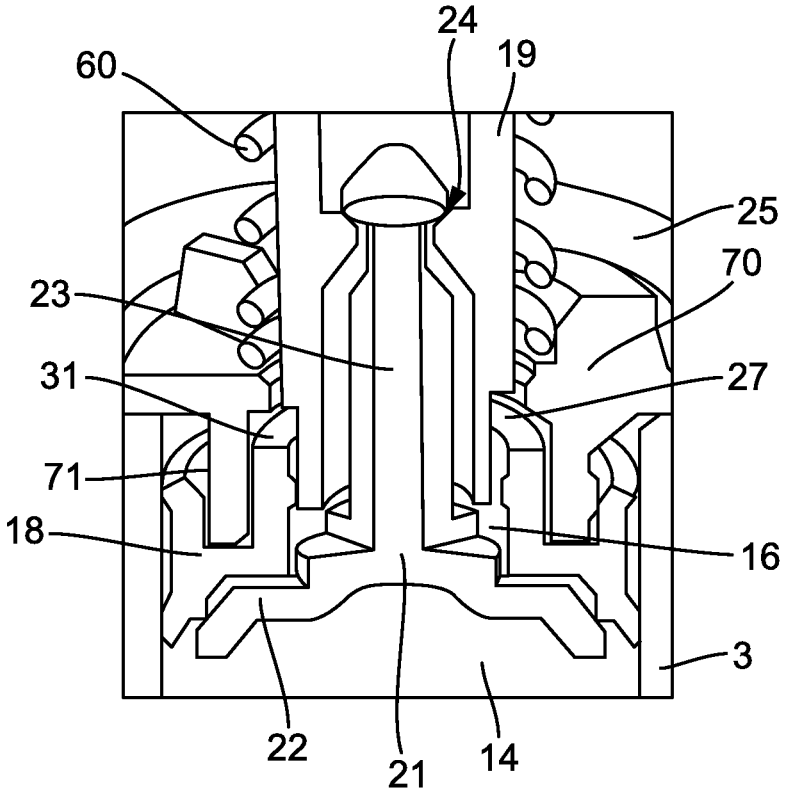
FIG. 2 shows a perspective view of a detail of the embodiment of FIG. 1.

The bottom end of the liquid piston 11 is shown in more detail in FIG. 2.

The liquid piston 11 comprises a liquid piston seal element 18 forming a seal between the liquid cylinder 3 and the liquid piston 11, and an elongate rod element 19. One end of the rod element 19 is connected to the liquid piston seal element 18 and the other end of the rod element 19 is connected to the common operating part 13. The rod element 19 comprises an internal channel 20.

The liquid piston seal element 18 comprises a central opening forming the liquid outlet 16. The liquid piston 11 comprises a valve element 21 comprising a sealing rim which may sealingly engage with the liquid piston seal element 18 as shown in FIG. 1. The liquid piston seal element 18 and the valve element 21 are movable with respect to each other between a closed position in which the liquid outlet 16 is substantially closed by the valve element 21, and an open position in which the liquid outlet 16 is at least partially open. In the open position, the liquid pump chamber 14 is via liquid outlet 16 in fluid communication with the internal channel 20 of the piston assembly 10.

The valve element 21 comprises a disc shaped part 22 having a sealing surface to form in the closed position a substantially sealing engagement with the liquid piston seal element 18, and an elongate extension part 23 extending into the internal channel 20 of the rod element 19. The free end of the extension part 23 comprises a bulge with a diameter larger than the diameter of a constriction 24 in the internal channel. The length of the extension part 23 between the disc shaped part 22 and the bulge is selected such that during an actuation and return stroke of the piston assembly 10 the valve element 21 and the liquid piston seal element 18 are movable with respect to each other between the closed position wherein there is a substantially sealing engagement between the disc shaped part 22 and the liquid piston seal element 18, and the open position wherein the disc shaped part 22 is spaced from the liquid piston seal element 18.

An air pump chamber 25 is delimited by the air piston 12, the air cylinder 4 the connecting wall 5 and an outer surface of the liquid piston 11. The air pump chamber 25 comprises an air inlet 26 and an air outlet 27. The air inlet 26 provides a fluid connection between the air pump chamber 25 and the environment. The air inlet 26 is at least partly formed by the air piston 12, and may for instance be formed by an opening in the air piston 12 or a space formed between the air piston 12 and the common operating part 13. A valve device is preferably provided in the air inlet 26. This valve device may for example be a one-way valve arranged in the air inlet 26 formed by an opening in the air piston or may be formed by use of a lost motion air piston which may move with respect to the common operating part 13 to open and close the air inlet 26. Both embodiments forming an air inlet with valve device are known in the art.

The air outlet 27 is formed by an opening formed between the piston seal element 18 and the rod element 19. In the embodiment shown in FIG. 1, the opening is formed by a slot provided in the rod element 19. The opening of the air outlet 27 may also be provided in the piston seal element 18 or completely in the rod element 19. The air outlet 27 provides fluid communication between the air pump chamber 25 and the internal channel 20 in the rod element 19.

The internal channel 20 is part of a dispensing channel 28 running through the piston assembly 10 to a dispensing opening 29 to dispense a foam formed by actuation of the piston assembly by depression of the common operating part 13. In the dispensing channel 28 a cylindrical sieve carrier element 30 is arranged. The two ends of the sieve carrier element 30 are each covered by a sieve 30A to promote the formation and homogenization of the foam.

The foam dispensing assembly 1 is shown in a completely upright position, i.e. the vertical axis corresponds with the longitudinal axis A-A. The foam dispensing assembly 1 is designed to be used in an upright position, wherein the piston assembly 10 at least partially moves downwards, when the common operating part 13 is depressed for actuation of the liquid pump and air pump. The upright position may be a completely upright position wherein the vertical axis corresponds with the longitudinal axis A-A, as shown in FIG. 1, but also a tilted position, for example with an angle of the longitudinal axis A-A of maximally 70 degrees with respect to the vertical axis.

In FIG. 1, the dispensing assembly 1 is shown in rest position. A spring 60 is provided between a top end of the rod element 19 and a spring support element 70 which is arranged at a fixed location in the double cylinder element 2. The spring 60 biases the piston assembly 10 to an upper position, wherein the liquid piston 11 and the air piston 12 are arranged relatively close to the upper end of the liquid cylinder 3 and the air cylinder 4, respectively. As the piston assembly 10 is biased in the upper position, the bulge of the extension part 23 is pulled upwards by the edge of the constriction 24, and therewith the disc shaped part 22 is pulled against the liquid piston seal element 18. At the same time, a downwardly directed cylindrical extension 71 of the spring support element 70 forms a stop for upwards movement of the liquid piston seal element 18. As a result, the liquid outlet 16 is properly closed off by the valve element 21, in the upper position of the piston assembly. This may avoid leakage when the dispensing assembly 1 and container 100 are inverted to an upside-down position.

It is remarked that the engagement between the bulge of the extension part 23 and the edge forming the constriction 24 may also form a sealing engagement preventing that liquid and/or air can pass the constriction 24 when the piston assembly is in its upper position.

When the common operating part 13 is depressed, the liquid piston 11 and the air piston 12 will be moved downwards therewith decreasing the volume of the liquid pump chamber 14 and the air pump chamber 25, respectively. As a result, liquid in the liquid pump chamber 14 and air in the air pump chamber 25 will be pressurized. The liquid will flow out of the liquid pump chamber 14 via the liquid outlet 16 and the air will flow out of the air pump chamber 25 via the air outlet 27. The air and liquid will commingle in the internal channel 20 to form a (pre-)foam.

The mixture of the air and liquid will move through the dispensing channel 28 towards the dispensing opening 29. In the dispensing channel 28, the mixture of air and liquid will be pressed through the sieves 30A of the sieve carrier element 30 to promote formation and homogenization of a foam. The foam will be dispensed at the dispensing opening 29.

It is remarked that at the beginning of the actuation of the piston assembly 10, by depression of the common operation element 13, the rod element 19 will be moved downwards. Due to friction between the liquid piston seal element 18 and the wall of the liquid cylinder 3, the liquid piston seal element 18 will, at first, remain in its position. As a result, the valve element 21 may move to the open position therewith opening the liquid outlet 16. After a small so-called lost motion stroke, the rod element 19 will be pushed against an upper rim 31 of the liquid piston seal element 18 so that the liquid piston seal element 18 will also move downwards together with the rod element 19.

It may be advantageous to have the lost motion stroke of the air inlet valve device of the air inlet 26 smaller than the lost motion stroke of the liquid piston seal element 18 such that air is compressed and pumped from the air pump chamber 25 before liquid is pumped from the liquid pump chamber 14. In this way it may be avoided that liquid is pumped into the air pump chamber 25.

The air piston 12 comprises an upper lip and a lower lip which are in sealing engagement with the air cylinder 4. In the upper position of the piston assembly 10, as shown in FIG. 1, the opening 4*a* is sealed by the upper lip and lower lip. However, when the common operating element 13 is depressed the upper lip will pass the opening 4*a* which places the interior of the container in communication with the environmental air. When the pressure in the container has decreased due to liquid being pumped out of the container, the pressure may be leveled to the environmental pressure by introduction of air into the container through the opening 4*a*.

When the common operating part 13 is released, the spring 60 will push the piston assembly 10 back into the upper position shown in FIG. 1. During this return stroke of the piston assembly 10 liquid will be drawn from the interior of the container 100 into the liquid pump chamber 14 and air will be drawn from the environment into the air pump chamber 25 via the air inlet 26.

During this return stroke air may also be drawn into the air pump chamber 25 via the air outlet 27, since no valve is arranged in the air outlet 27. This amount may be relatively small since the air outlet 27 forms a restriction as the cross area of the air outlet 27 is small. Also the presence of foam in the dispensing channel 28, and in particular in the sieves 30A may hinder the flow of air into the dispensing channel 28 to the air pump chamber 25. In alternative embodiments a valve device may be provided in the air outlet 27 to avoid that air and/or liquid flows from the dispensing channel 28 through the air outlet 27 into the air pump chamber 25.

However, in other embodiments the flow of air and/or liquid drawn into the air pump chamber 25 through the air outlet 27 during the return stroke may be relatively large, for instance when it is desired to clean the dispensing channel 28 by sucking a substantial part of the liquid and air in the dispensing channel 28 into the air pump chamber 25. In such self-cleaning embodiment, the air outlet 27 may also be used as the only air inlet 26, thus combining the air inlet and air outlet in a single opening between the air pump chamber 25 and the dispensing channel 28.

When air is drawn into the air pump chamber 25 liquid may be drawn into the air pump chamber 25 together with the air. For example, when air is drawn out of the dispensing channel 28 via the air outlet 27, foam present in the dispensing channel 28 may be drawn into the air pump chamber 25.

The presence of liquid in the air pump chamber 25 is generally undesirable as the liquid may hamper the functioning of the air pump, in particular the sliding seal between air piston 12 and air cylinder 4. In many prior art embodiments valves or other measures are taken to avoid the ingress of liquid into the air pump chamber 25.

The embodiment of FIG. 1 provides an alternative solution wherein the air outlet 27 is provided in the liquid piston in a region of the air pump chamber 25 opposite to the air piston 12. As the air piston 12 is arranged at an upper end of the air pump chamber 25, the air outlet 27 is arranged at or near a bottom of the interior of the air pump chamber.

Such location of the air outlet 27 has the advantage that at least a substantial part of liquid drawn or leaked into the air pump chamber will be pumped out during a next pump stroke of the piston assembly 10.

This has the advantage that no accumulation of liquid occurs in the air pump chamber 25.

It is remarked that the connecting wall 5 connecting a bottom end of the air cylinder 4 to a top end of the liquid cylinder 3 is designed to diverge from the liquid cylinder 3 to the air cylinder 4 such that liquid present in the air cylinder 4 will run, when the foam dispensing assembly 1 is positioned in an upright position, towards the liquid cylinder 3 and air outlet 27 as a result of the diverging shape. The connecting wall 5 may, for example, have a conical or frusto-conical shape.

Figure 3:
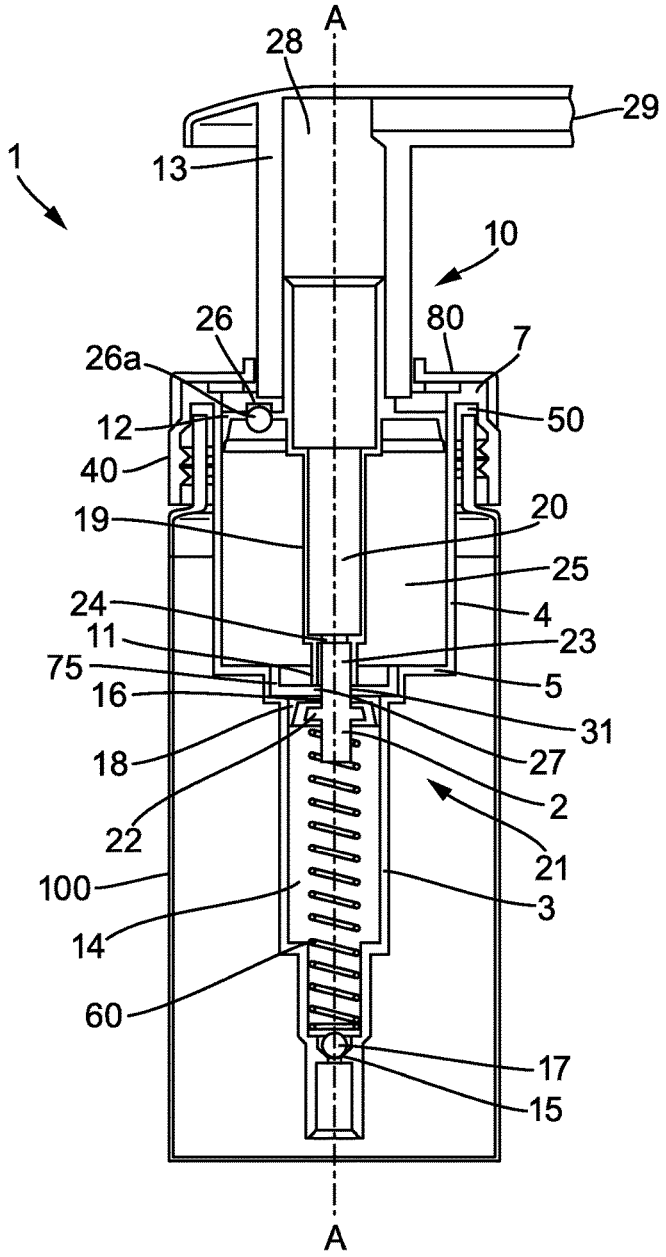
FIGS. 3 and 4 show a second embodiment of a foam dispensing device according to the invention.
Figure 4:
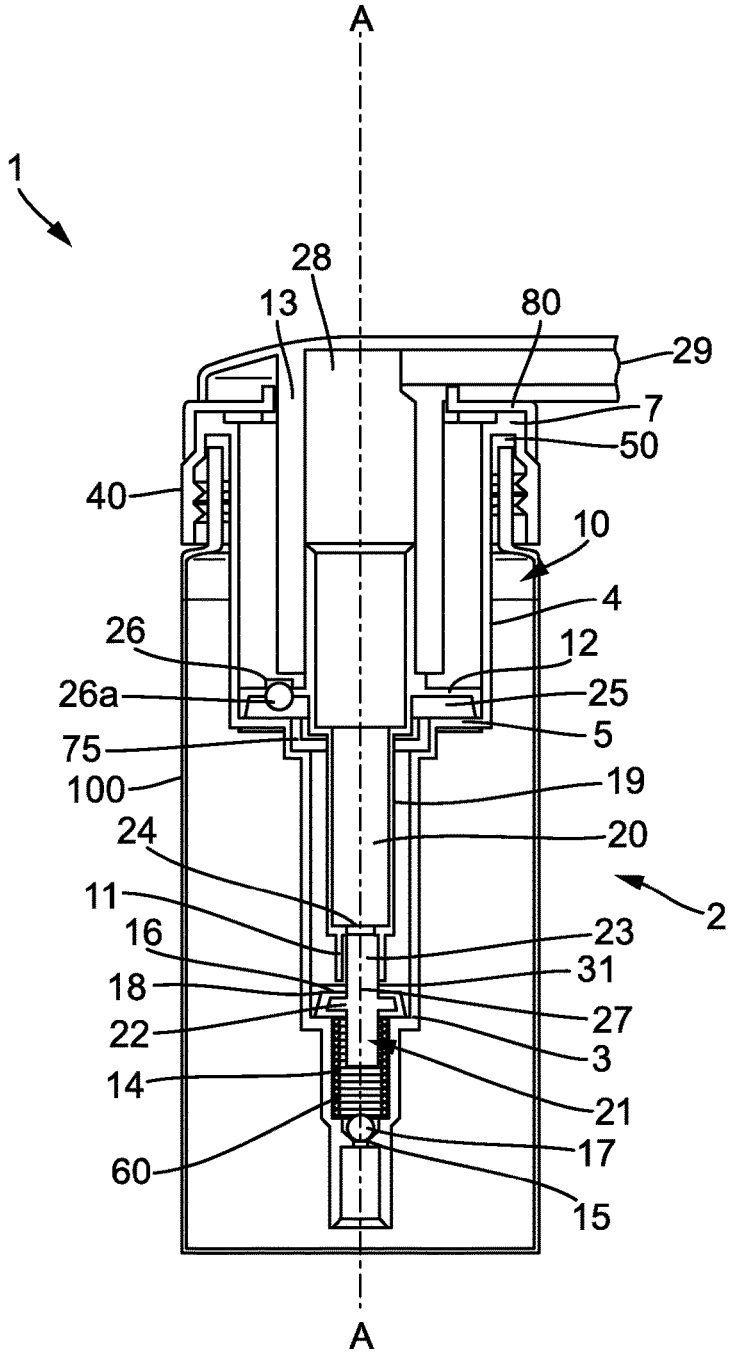

FIGS. 3 and 4 show an alternative embodiment of a dispensing assembly mounted on an opening of a container 100. Parts which are substantially the same or have substantially the same function are indicated by the same reference numerals.

In FIG. 3 the piston assembly 10 is shown in the upper position, for example at the beginning of an actuation stroke of the piston assembly 10. In FIG. 4, the piston assembly 10 is shown at the end of the actuation stroke, i.e. the common operating part 13 is fully depressed.

In the embodiment shown in FIGS. 3 and 4, the double cylinder element 2 and the securing collar 40 are formed as an integral element connected at the flange 7. A separate cover element 80 is provided to cover an upper side of the double cylinder element 2. The cover element 80 comprises a central opening through which the common operating element 13 extends.

The air piston 12 comprises an air inlet 26, in which a ball valve 26*a* is arranged as a one way valve which only allows air to go into the air pump chamber 25. The air piston 12 is formed as an integral part with the rod element 19 and the sieve carrier element 30.

The liquid piston 11 comprises a liquid piston seal element 18, a rod element 19 and a valve element 21. The rod element 19 comprises an internal channel 20 forming a part of the dispensing channel 28.

The liquid piston seal element 18 comprises a central opening forming a liquid outlet 16. The valve element 21 comprises a disc shaped part 22 having a sealing surface which cooperates with a sealing edge of the central opening of the liquid piston seal element 18. The valve element 21 further comprises an extension part 23 extending into the internal channel 20. In the internal channel 20 a constriction 24 is formed by an opening in a restriction wall. The upper end of the extension part 23 has a width larger than the constriction 24.

The valve element 21 is movable with respect to the liquid piston seal element 18 between a closed position, in which the valve element 21, in particular the sealing surface of the disc shaped part 22, is in a sealing engagement with the liquid piston seal element 18 and an open position, in which the valve element 21 is spaced from the liquid piston seal element 18 so that liquid can pass therebetween.

A spring 60 arranged in the liquid pump chamber 14 biases the valve element 21 towards the closed position.

A stop element 75 is arranged at a fixed location in the double cylinder element 2. In the upper position of the piston assembly 10, as shown in FIG. 3, the liquid piston seal element 18 is pushed by the spring 60 and the valve element 21 against the stop element 75.

The air piston 12 comprises an air inlet 26, in which a ball valve 26 is arranged as a one way valve which only allows air to go into the air pump chamber 25. The air piston 12 is formed as an integral part with the rod element 19 and the sieve carrier element 30.

The air outlet 27 of the air pump chamber 25 is formed in the liquid piston 11 between the rod element 19 and the liquid piston seal element 18. The air outlet 27 is formed by an opening in an upper rim 31 of the liquid piston seal element 18. The opening may for example also be formed in the lower end of the rod element 19.

At the beginning of the actuation of the piston assembly 10, by depression of the common operation element 13, the rod element 19 will be moved downwards. Due to the downwards movement of the rod element 19, the constriction wall forming the constriction 24 will be pushed against the extension part 23 of the valve element 21, and the valve element 21 will also move downwards. Due to friction between the liquid piston seal element 18 and the wall of the liquid cylinder 3, the liquid piston seal element 18 will, at first, remain in its position. As a result, the valve element 21 may move to the open position therewith opening the liquid outlet 16.

The rod element 19 will be pushed against the upper rim 31 of the liquid piston seal element 18 so that the liquid piston seal element 18 will also move downwards together with the rod element 19.

When the common operating part 13 is further depressed, the liquid piston 11 and the air piston 12 will be moved downwards therewith decreasing the volume of the liquid pump chamber 14 and the air pump chamber 25, respectively. As a result, liquid in the liquid pump chamber 14 and air in the air pump chamber 25 will be pressurized. The liquid will flow out of the liquid pump chamber 14 via the liquid outlet 16 and the air will flow out of the air pump chamber 25 via the air outlet 27. When liquid would be present in the air pump chamber 25, a substantial part of this liquid would also be pumped out of the air pump chamber 25 as the air outlet is arranged in the air pump chamber 25 opposite to the air piston 12, in the bottom region of the air pump chamber 25.

The air and liquid will commingle in the internal channel 20 to form a mixture of air and liquid. The mixture of the air and liquid will move through the dispensing channel 28 towards the dispensing opening 29. In the dispensing channel 28, the mixture of air and liquid may be pressed through sieves of a sieve carrier element (not shown) to promote formation and homogenization of a foam. The foam will be dispensed at the dispensing opening 29.

It is remarked that it may be advantageous that the liquid piston 11 is a so called lost motion piston which requires a small stroke before actually pumping liquid, and the air piston is a piston fixed to the common operating part 13. As a result, the actual pumping of air from the air pump chamber 25 may start before the pumping of liquid from the liquid pump chamber 14. This may avoid that liquid is pumped from the liquid pump chamber 14 directly into the air pump chamber 25.

FIG. 4 shows the piston assembly 10 at the end of the actuation stroke. The valve element 21 is still in the open position. When the common operating part 13 is released the spring 60 will push the piston assembly 10 back into the top position shown in FIG. 3. During this return stroke of the piston assembly 10 liquid will be drawn via the liquid inlet 15 from the interior of the container 100 into the liquid pump chamber 14 and air will be drawn via the air inlet 26 from the environment into the air pump chamber 25.

If any liquid would come into the air pump chamber 25, at least a substantial part of the liquid will be pumped out of the air pump chamber during the next actuation stroke of the piston assembly 10. Since the liquid can be pumped out of the air pump chamber 25 and will not accumulate in the air pump chamber 25, the presence of this liquid will have a less harmful effect on the functioning of the foam-forming assembly 1.

Figure 5:
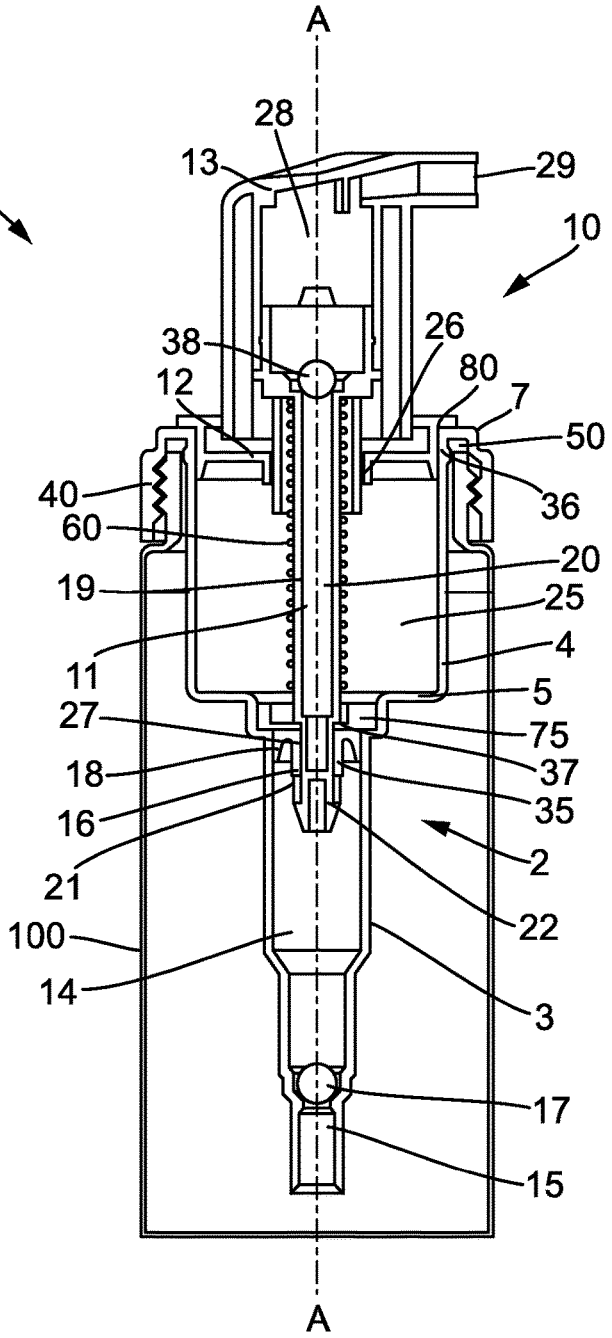
FIGS. 5 and 6 show a third embodiment of a foam dispensing device according to the invention.
Figure 6:
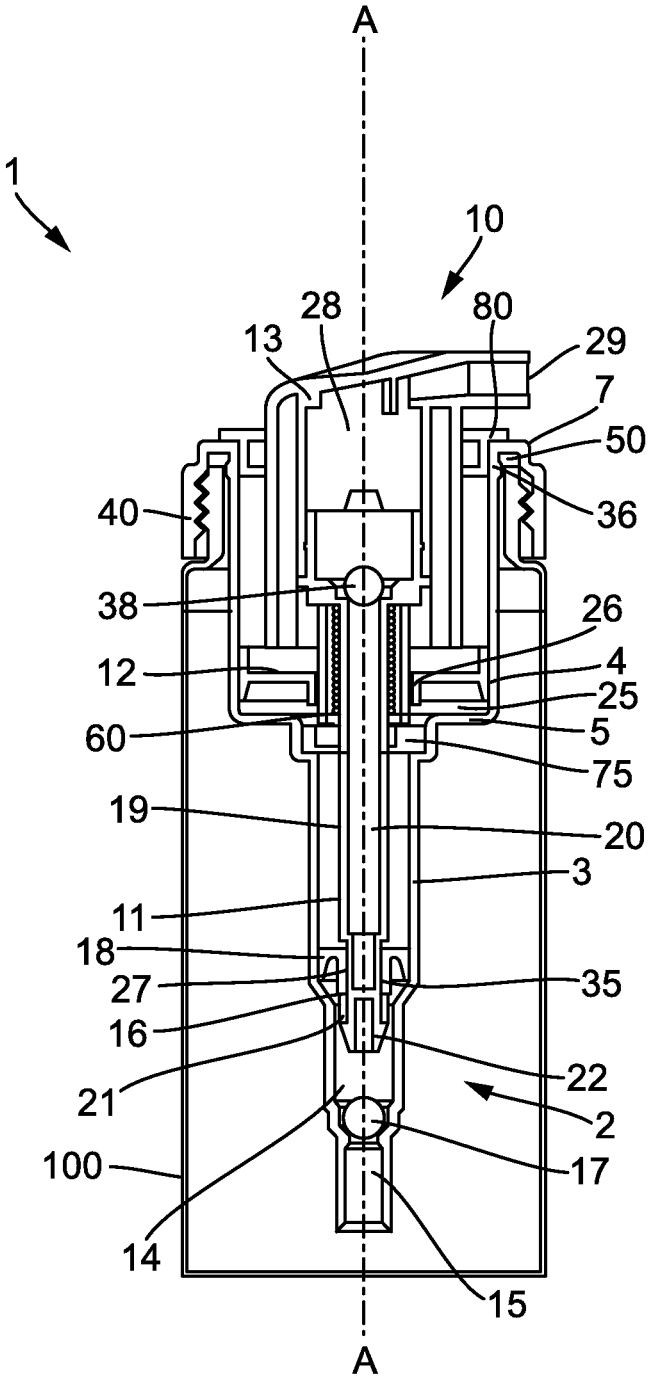

FIGS. 5 and 6 show a second alternative embodiment of a dispensing assembly mounted on an opening of a container 100. Parts which are substantially the same or have substantially the same function are indicated by the same reference numerals.

In FIG. 5 the piston assembly 10 is shown in the upper position, for example at the beginning of an actuation stroke of the piston assembly 1. In FIG. 6, the piston assembly 10 is shown at the end of the actuation stroke, i.e. the common operating part 13 is fully depressed.

In the embodiment shown in FIGS. 5 and 6, the double cylinder element 2 and the securing collar 40 are, similar to the embodiments of FIGS. 5 and 6, formed as an integral element connected at the flange 7. A separate cover element 80 is provided to cover an upper side of the double cylinder element 2. The cover element 80 comprises a central opening through which the common operating element 13 extends.

In the upper position of the air piston 12, the upper lip of the air piston 12 is in sealing engagement with the cover element 80. In the double cylinder element 2 an opening 36 is provided which is in fluid communication with the interior of the container 100. As the opening 36 is covered by the upper lip of the air piston 12 and the cover element 80 which are in sealing engagement, the interior of the container 100 and the environment are not in fluid communication. However, when the air piston 12 is moved downwards, for instance caused by depression of the common operating part 13 there will be created a spaced relationship between the cover element 80 and the air piston 12 and air can flow from the environment into the interior of the container 100 through the opening 36.

Between an upper part of the liquid piston 11 and the air piston 12 an air inlet 26 is formed. By relative axial movement of the liquid piston 11 and the air piston 12, the air inlet 26 can be opened and closed. During a downward actuation stroke the air inlet 26 will be closed so that all pumped air will leave the air pump chamber 25 through the air outlet and during a return stroke the air inlet 26 will be open so that air can be sucked into the container 100 through the air inlet 26.

The liquid piston 11 comprises a liquid piston seal element 18, a rod element 19 and a valve element 21. The rod element 19 comprises an internal channel 20 forming a part of the dispensing channel 28.

The air outlet 27 of the air pump chamber 25 is formed in the liquid piston 11 between the rod element 19 and the liquid piston seal element 18. The air outlet 27 runs to a number of openings 35 in the rod element 19 which openings place the air outlet 27 in fluid communication with the internal channel 20. In an alternative embodiment, the air outlet 27 may be formed by one or more openings 35 which directly run into the air pump chamber 25.

The rod element 19 comprises a lower end about which the liquid piston seal element 18 and the valve element 21 are arranged. The liquid piston seal element 18 is movable in axial direction with respect to the rod element 19, while the valve element 21 is held in a fixed position with respect to the rod element 19. A liquid outlet 16 is formed between the valve element 21 and the liquid piston seal element 18. The liquid outlet 16 runs to the openings 35 in the rod element 19. The openings 35 thus also place the liquid outlet 16 in fluid communication with the internal channel 20

In the upper position of the piston assembly 10, in which the piston assembly 10 is biased by spring 60, the liquid piston seal element 18 is pushed by the stop element 75 against the valve element 21 in a sealing relationship.

When the liquid piston 11 is pushed downwards the liquid piston seal element 18 will remain at first in its position due to friction between the liquid piston seal element 18 and the inner wall of the liquid cylinder, while the valve element 21 moves downwards together with the rod element 19. As a result, a spaced relationship is created between the liquid piston seal element 18 and the valve element 21 so that liquid from the liquid pump chamber can flow through the liquid outlet 16 and the openings 35.

After a relative small stroke of the liquid piston a widening 37 of the rod element 19 will stop relative movement of the liquid piston seal element 18 with respect to the rod element 19, so that the liquid piston seal element 18 will move downwards together with the rod element 19, while the valve element 21 is in the spaced open position with respect to the liquid piston seal element 18.

During the downwards stroke of the liquid piston 11 and the air piston 12 the volume of the liquid pump chamber 14 and the air pump chamber 25 will be decreased. As a result, liquid in the liquid pump chamber 14 and air in the air pump chamber 25 will be pressurized.

Liquid will flow out of the liquid pump chamber 14 through the liquid outlet 16 and the openings 35 into the internal channel 20. Air will flow out of the air pump chamber 25 through the air outlet 27 and the openings 35 into the internal channel 20. The air and liquid will commingle in the internal channel 20 to form a mixture of air and liquid. The mixture of the air and liquid will move through the dispensing channel 28 towards the dispensing opening 29. In the dispensing channel 28, a number of sieve elements (not shown) or other features promoting formation of a foam may be provided to improve foam quality.

FIG. 6 shows the piston assembly at the end of the actuation stroke. The valve element 21 is still in the open position with respect to the liquid piston seal element 18.

When the common operating part 13 is released the spring 60 will push the piston assembly 10 back into the top position shown in FIG. 3. At the beginning of this return stroke the liquid piston seal element 18 will move back due to friction with the internal wall of the liquid cylinder 3 will move back into the sealing engagement with the valve element 21, and the air piston 12 will move to the open position with respect to the liquid piston so that air inlet 26 is opened During the return stroke of the piston assembly 10 liquid will be drawn via the liquid inlet 15 from the interior of the container 100 into the liquid pump chamber 14 and air will be drawn via the air inlet 26 from the environment into the air pump chamber 25. A one way valve 38 is arranged in the dispensing channel 28 to avoid or at least reduce that foam, liquid and/or air from the dispensing channel 28 is drawn into the air pump chamber 25 during the return stroke.

However, if any liquid would come into the air pump chamber 25, at least a substantial part of the liquid will be pumped out of the air pump chamber 25 during the next actuation stroke of the piston assembly 10.

At the end of the return stroke, the piston assembly will again be positioned as shown in FIG. 5.

Other embodiments of the invention will be apparent to those skilled in the art from consideration of the specification and practice of the invention disclosed herein. The different features described and shown with respect to the different embodiments may be combined in any suitable combination.

For example, the air piston of the second embodiment may be combined with the liquid piston of the first or third embodiment to create a further embodiment of a foam dispensing assembly.

It is intended that the specification and examples be considered as exemplary only, with a true scope and spirit of the invention being indicated by the following claims.

The invention claimed is:

1. A dispensing assembly to dispense a foam, comprising:

a double cylinder element mounted or to be mounted in or on an opening of a container, comprising a liquid cylinder and an air cylinder, wherein the liquid cylinder has a smaller diameter than the air cylinder, and wherein the liquid cylinder and the air cylinder are arranged concentrically, and a piston assembly comprising a liquid piston and an air piston for reciprocal movements in the liquid cylinder and air cylinder, respectively, and a common operating part for operating the liquid piston and air piston, wherein a liquid pump chamber is at least delimited by the liquid cylinder and the liquid piston, said liquid pump chamber having a liquid inlet and a liquid outlet, wherein an air pump chamber is at least delimited by the air cylinder, the air piston and the liquid piston, said air pump chamber having an air inlet and an air outlet, wherein the piston assembly further comprises a dispensing channel in fluid communication with the liquid outlet and the air outlet, wherein the dispensing channel ends in a dispensing opening, wherein the air outlet is at least partly provided in the liquid piston in a region of the air pump chamber opposite to the air piston at the bottom of the air pump chamber;

wherein the dispensing assembly is configured such that, when used in an upright position, any liquid present in the air pump chamber will flow towards the bottom of the air pump chamber and will be pumped out of the air pump chamber through the air outlet upon actuation of the air piston; and wherein a spring support element is arranged in the double cylinder element, wherein a spring is arranged between the spring support element and the piston assembly to bias the piston assembly in an upper position of an actuation stroke, and wherein the spring support element comprises a stop which holds a piston seal element and a valve element in the closed position with respect to each other.

2. The dispensing assembly as claimed in claim 1, wherein the air pump chamber is arranged completely above the liquid pump chamber.

3. The dispensing assembly as claimed in claim 1, wherein the liquid piston comprises a valve element forming a valve in the liquid outlet.

4. The dispensing assembly as claimed in claim 1, wherein the liquid piston comprises:

a liquid piston seal element forming a seal between the liquid cylinder and the liquid piston, and an elongate hollow rod element, wherein one end of the elongate hollow rod element is connected to the liquid piston seal element and the other end of the elongate hollow rod element is connected to the common operating part.

5. The dispensing assembly as claimed in claim 4, wherein the air outlet is formed between the liquid piston seal element and the elongate hollow rod element.

6. The dispensing assembly as claimed in claim 4, wherein the liquid piston seal element comprises an opening forming the liquid outlet, and wherein the liquid piston comprises a valve element, wherein the valve element and the liquid piston seal are movable with respect to each other between a closed position in which the opening is closed by the valve element, and an open position in which the opening is at least partially open.

7. The dispensing assembly as claimed in claim 6, wherein the valve element comprises an annular sealing surface to cooperate with an annular sealing surface on the liquid piston seal element.

8. The dispensing assembly as claimed in claim 6, wherein the internal channel in the elongate hollow rod element comprises a constriction, wherein the valve element comprises a disc shaped part having a sealing surface to form in the closed position a sealing engagement with the piston seal element, and an elongate extension part extending into the elongate hollow rod element, wherein a free end of the extension part comprises a bulge with a diameter larger than the diameter of the constriction in the internal channel.

9. The dispensing assembly as claimed in claim 1, wherein the liquid cylinder is not enclosed by the air cylinder, wherein the double cylinder element comprises a connecting wall connecting a bottom end of the air cylinder with a top end of the liquid cylinder, and wherein the connecting wall is designed such that, in the upright position of the dispensing assembly liquid in the air pump chamber will run to the liquid cylinder.

10. The dispensing assembly as claimed in claim 1, wherein the liquid piston comprises a cylindrical piston rod and the dispensing assembly comprises a cylindrical spring element arranged to bias the piston assembly to a start position of an actuation stroke, wherein the cylindrical spring element is arranged around the cylindrical piston rod, and wherein an inner diameter of the cylindrical spring element is slightly larger than an outer diameter of the piston rod, such that the cylindrical piston rod guides the cylindrical spring element during compression of the cylindrical spring element in an actuation stroke of the piston assembly.

11. The dispensing assembly as claimed in claim 10, wherein the cylindrical spring element is a helical spring element.

12. The dispensing assembly as claimed in claim 1, wherein the piston assembly is configured such that upon actuation of the piston assembly, pumping of air out through the air outlet starts before pumping of liquid through the liquid outlet.

13. Foam dispensing device comprising:

a container containing a foamable liquid and having an opening, and the dispensing assembly of claim 1 mounted on or in the opening of the container.

14. A dispensing assembly to dispense a foam, comprising:

a double cylinder element mounted or to be mounted in or on an opening of a container, comprising a liquid cylinder and an air cylinder, wherein the liquid cylinder has a smaller diameter than the air cylinder, and wherein the liquid cylinder and the air cylinder are arranged concentrically, and a piston assembly comprising a liquid piston and an air piston for reciprocal movements in the liquid cylinder and air cylinder, respectively, and a common operating part for operating the liquid piston and air piston, wherein a liquid pump chamber is at least delimited by the liquid cylinder and the liquid piston, said liquid pump chamber having a liquid inlet and a liquid outlet, wherein an air pump chamber is at least delimited by the air cylinder, the air piston and the liquid piston, said air pump chamber having an air inlet and an air outlet, wherein the piston assembly further comprises a dispensing channel in fluid communication with the liquid outlet and the air outlet, wherein the dispensing channel ends in a dispensing opening, wherein the air outlet is at least partly provided in the liquid piston in a region of the air pump chamber opposite to the air piston, at the bottom of the air pump chamber, the liquid piston comprising:

a liquid piston seal element forming a seal between the liquid cylinder and the liquid piston, the liquid piston seal element comprising an opening forming the liquid outlet, an elongate hollow rod element, wherein one end of the elongate hollow rod element is connected to the liquid piston seal element and the other end of the elongate hollow rod element is connected to the common operating part, and a valve element, wherein the valve element and the liquid piston seal element are movable with respect to each other between a closed position in which the opening of the liquid piston seal element is closed by the valve element, and an open position in which the opening of the liquid piston seal element is at least partially open; and wherein the dispensing assembly is configured such that, when used in an upright position, any liquid present in the air pump chamber will flow towards the bottom of the air pump chamber and will be pumped out of the air pump chamber through the air outlet upon actuation of the air piston.

15. The dispensing assembly as claimed in claim 14, wherein the valve element comprises an annular sealing surface to cooperate with an annular sealing surface on the liquid piston seal element.

16. The dispensing assembly as claimed in claim 14, wherein the internal channel in the elongate hollow rod element comprises a constriction, wherein the valve element comprises a disc shaped part having a sealing surface to form in the closed position a sealing engagement with the piston seal element, and an elongate extension part extending into the elongate hollow rod element, wherein a free end of the extension part comprises a bulge with a diameter larger than the diameter of the constriction in the internal channel.

17. A dispensing assembly to dispense a foam, comprising:

a double cylinder element mounted or to be mounted in or on an opening of a container, comprising a liquid cylinder and an air cylinder, wherein the liquid cylinder has a smaller diameter than the air cylinder, and wherein the liquid cylinder and the air cylinder are arranged concentrically, and a piston assembly comprising a liquid piston and an air piston for reciprocal movements in the liquid cylinder and air cylinder, respectively, and a common operating part for operating the liquid piston and air piston, wherein a liquid pump chamber is at least delimited by the liquid cylinder and the liquid piston, said liquid pump chamber having a liquid inlet and a liquid outlet, wherein an air pump chamber is at least delimited by the air cylinder, the air piston and the liquid piston, said air pump chamber having an air inlet and an air outlet, wherein the piston assembly further comprises a dispensing channel in fluid communication with the liquid outlet and the air outlet, wherein the dispensing channel ends in a dispensing opening, wherein the air outlet is at least partly provided in the liquid piston in a region of the air pump chamber opposite to the air piston, at the bottom of the air pump chamber, wherein the dispensing assembly is configured such that, when used in an upright position, any liquid present in the air pump chamber will flow towards the bottom of the air pump chamber and will be pumped out of the air pump chamber through the air outlet upon actuation of the air piston, and wherein the liquid piston comprises a cylindrical piston rod and the dispensing assembly comprises a cylindrical spring element arranged to bias the piston assembly to a start position of an actuation stroke, wherein the cylindrical spring element is arranged around the cylindrical piston rod, and wherein an inner diameter of the cylindrical spring element is slightly larger than an outer diameter of the piston rod, such that the cylindrical piston rod guides the cylindrical spring element during compression of the cylindrical spring element in an actuation stroke of the piston assembly.

18. The dispensing assembly as claimed in claim 17, wherein the cylindrical spring element is a helical spring element.

* * * * *